US009373297B2

(12) United States Patent
Herrmann

(10) Patent No.: US 9,373,297 B2
(45) Date of Patent: Jun. 21, 2016

(54) POWER SAVING DRIVE MODE FOR BI-LEVEL VIDEO

(75) Inventor: Frederick P. Herrmann, Sharon, MA (US)

(73) Assignee: Kopin Corporation, Westborough, MA (US)

( * ) Notice: Subject to any disclaimer, the term of this patent is extended or adjusted under 35 U.S.C. 154(b) by 257 days.

(21) Appl. No.: 13/619,276

(22) Filed: Sep. 14, 2012

(65) Prior Publication Data

US 2013/0069999 A1 Mar. 21, 2013

Related U.S. Application Data

(60) Provisional application No. 61/535,444, filed on Sep. 16, 2011.

(51) Int. Cl.
*G09G 3/36* (2006.01)

(52) U.S. Cl.
CPC ..... *G09G 3/3685* (2013.01); *G09G 2310/027* (2013.01)

(58) Field of Classification Search
CPC ..... G09G 3/3685; G09G 2310/027
USPC ..... 345/100, 98, 96
See application file for complete search history.

(56) References Cited

U.S. PATENT DOCUMENTS 7,088,328 B2 * 8/2006 Inada ..... G09G 3/3614 345/209
7,138,993 B2 * 11/2006 Herrmann ..... 345/205
7,633,479 B2 * 12/2009 Kobayashi ..... G09G 3/3614 345/55
8,749,539 B2 * 6/2014 Hung ..... G09G 3/3614 345/209
2002/0097208 A1 * 7/2002 Hashimoto ..... 345/87
2003/0174113 A1 * 9/2003 Herrmann ..... G09G 3/3614 345/96
2007/0247408 A1 * 10/2007 Nishimura ..... G09G 3/3688 345/89
2008/0055300 A1 * 3/2008 Yamazaki ..... 345/212
2009/0167747 A1 7/2009 Gong et al.

FOREIGN PATENT DOCUMENTS

JP 2009-025656 2/2009
WO WO 2013/040377 3/2013

OTHER PUBLICATIONS

Notification of Transmittal of the International Search Report and the Written Opinion of the International Searching Authority, or the Declaration for International Application No. PCT/US2012/055454 entitled "Power-Saving Drive Mode for Bi-Level Video," mailing date Jan. 22, 2013.

* cited by examiner

*Primary Examiner* — Kumar Patel
*Assistant Examiner* — Sejoon Ahn
(74) *Attorney, Agent, or Firm* — Hamilton, Brook, Smith & Reynolds, P.C.

(57) ABSTRACT

Liquid crystal display (LCD) driver circuits, and corresponding driving methods, having selectable grayscale and bi-level modes, that also provide DC restore are presented, including an example embodiment driver circuit having selectable direct current (DC) restore voltage switches including a digital to analog converter, a high voltage video signal path including a high voltage video amplifier, a set of high voltage level switches, a high voltage capacitor and a low voltage video signal path including a low voltage video amplifier, a set of low voltage level switches, a low voltage capacitor. Advantages include, for some applications, a display operates in a bi-level mode saving power relative to operating in a grayscale mode, while also being able to offer full grayscale mode in other applications. Further, advantages of some example embodiments include an extended DC-restore mode providing a longer period of DC restore voltage.

21 Claims, 5 Drawing Sheets

POWER SAVING DRIVE MODE FOR BI-LEVEL VIDEO

RELATED APPLICATION(S)

This application claims the benefit of U.S. Provisional Application No. 61/535,444, invented by Frederick P. Herrmann, filed on Sep. 16, 2011, entitled, "Power Saving Drive Mode For Bi-Level Video." The entire teachings of the above application are incorporated herein by reference.

BACKGROUND

In many liquid crystal display (LCD) configurations, and particularly those employing the commonly-used twisted nematic (TN) phase, the brightness of a pixel is modulated by the voltage applied across the liquid crystal (LC) cell. The voltage affects the degree to which the LC material rotates polarized light, which in turn controls how much light passes through an exit polarizer. In other words, a LCD is a passive device that acts as a light valve. The managing and controlling of data to be displayed is typically performed by one or more circuits, which are commonly referred to as display driver circuits or simply drivers.

Grayscale can be achieved by driving varying analog voltages to LCD pixels. Analog video amplifiers are often used in the video signal path of LCD driven circuits. If the video signal source is digital, then one or more digital-to-analog converters (DACs) will typically be used to convert the digital video signal into a corresponding analog video signal. An important consideration in the design of video electronics is the power dissipation of these analog circuits because the DACs and amplifiers can account for a significant, or even dominant, portion of the system power budget.

Some display applications require pixels driven to purely white or black, and do not use intermediate gray levels. Such purely white or black applications are referred to as bi-level video systems. With only one bit per pixel, these bi-level video systems can often be simpler to drive than grayscale systems, since the DAC and video amplifier and can often be replaced with a switch to select between the voltages associated with driving a LCD to black and white.

Generally, LCDs do not work well with direct current (DC) voltages. A graph of transmission versus voltage applied to a LCD is shown in FIG. 1. High transmission occurs with zero voltage and low transmission with either positive or negative voltage. Therefore, to drive a LCD to black, a positive or negative voltage can be applied to the LCD. However, driving a LCD at a steady state DC voltage may damage the display by, for example, causing contaminants to plate on one side or the other of the LC cell. In order to prevent damage, the voltage applied to the LCD is generally flipped back and forth (alternated) between high-black and low-black, to preserve zero (0) DC voltage, also called DC restore.

There are different scenarios for preserving zero volts DC (0 Vdc), as shown in the series of succeeding frames of FIGS. 2A-2D. One scenario uses column inversion as shown in FIG. 2A, where one frame is written with all the columns having alternating polarity, positive-negative, and positive-negative. In the next frame all the columns are written negative-positive, negative-positive. In the succeeding frame, all the columns are again written positive-negative, positive-negative. As shown in FIG. 2B, frame inversion can be used where the first frame is written with all positives and the next frame is written with all negatives. The succeeding frame is again written with all positives. As shown in FIG. 2C, pixel inversion can be used which produces a checkerboard like effect in the first frame and an inverted effect in the second frame. In the third frame, the checkerboard like effect matches that of the first frame. Lastly, as shown in FIG. 2D, row inversion can be used where all the rows are alternating polarity, positive-negative, and positive-negative. In the next frame all the rows are written negative-positive, negative-positive. In the third frame, the rows are again written positive-negative, positive-negative.

One approach to implementing an alternating current-coupled (AC-coupled) display driver circuit with one or more direct current-restore (DC-restore) switches integrated within a LCD is U.S. Pat. No. 7,138,993, by Frederick P. Herrmann, issued on Nov. 21, 2006, and assigned to Kopin Corporation of Taunton, Mass., the entire contents of which are hereby incorporated by reference.

SUMMARY

Presented herein are corresponding methods and example embodiments of liquid crystal display (LCD) driver circuits having selectable grayscale and bi-level modes, that also provide DC restore. An example embodiment display driver circuit, and corresponding method for driving a display, having selectable grayscale and bi-level modes includes a digital to analog converter (DAC), video amplifier, set of level switches and enable circuit having a grayscale mode to enable the DAC and video amplifier, and a bi-level mode to enable a subset of the level switches and disable the DAC and video amplifier is presented.

When operating an example embodiment of the driver circuit in a bi-level mode, power is conserved relative to operating in grayscale mode because the switches used in bi-level mode use less power than the DAC and video amplifier.

The display driver circuit can include a high voltage level black switch, a low voltage level black switch, and a white voltage level switch. The white level voltage switch can be further comprised of a high voltage level white switch and a low voltage level white switch.

The DAC, video amplifier and set of level switches can be integrated in the same integrated circuit (IC). The set of level switches can be p-channel and n-channel metal-oxide semiconductor field-effect transistors (MOSFETs). The p-channel MOSFET can have a source terminal coupled to a high video reference voltage source. An n-channel MOSFET can have a terminal coupled to a low video reference voltage source.

The display driver circuit can be further implemented with different display colors, such as primary colors red, green, and blue, each color having three or four associated switches because color display uses at least three times as many switches as monochrome (e.g., black and white). The display driver circuit can further include a high video signal path or sub-channel and a low video signal path or sub-channel in parallel between the DAC and liquid crystal display. Each high and low video sub-channel (or path or branch) can respectively include a video amplifier, a set of level switches, and a capacitor.

A voltage DC restore mode or extended DC-restore mode can be enabled in the non-active video signal path.

Further presented herein is a liquid crystal display (LCD) driver circuit having selectable direct current (DC) restore voltage switches including a digital to analog converter, a high voltage video signal sub-channel including a high voltage video amplifier, set of high voltage level switches, high voltage capacitor, and a low voltage video signal sub-channel including a low voltage video amplifier, set of low voltage level switches, low voltage capacitor. The high voltage path can further include a high voltage enable circuit having a high voltage grayscale mode that enables a high voltage view amplifier and disables high voltage level switches, and an extended DC restore that provides a longer period of DC restore using a set of low level voltage switches. The low voltage sub-channel can further contain a low voltage enable circuit having a low voltage grayscale mode enabling the low voltage video amplifier and disabling the set of low voltage level switches, and an extended DC restore mode enabling a longer period of DC restore using the set of high voltage level.

A quiescent current of the high and low video amplifiers can be substantially the same. In grayscale modes, only one amplifier needs to be enabled at a time and thus supplied power during operation. The inactive amplifier can be powered down, so that the dual amplifier circuit uses no more power than a single amplifier circuit. This provides for power savings. DC restore mode can be enabled while the low voltage signal amplifier is active and the low voltage DC restore mode can be enabled while the high voltage video amplifier is active.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

Mobile electronic systems typically manage power carefully to prolong battery life and maximize the time between charges. It is common for such devices to have a "standby" or "sleep" mode which uses much less power than the normal operating mode. Other power-saving options may reduce performance or disable features. For example, many laptop computers may be configured to dim the screen and/or reduce CPU clock frequency when operating on battery power, and e-book readers may allow the user to disable wireless connectivity to conserve power.

Different power management modes may have different display requirements. It may be advantageous for a display to operate in a bi-level video mode for some applications, while also being able to offer full grayscale in others. For example, bi-level text and simple graphics could provide status information in a standby mode. In another example, an e-book reading application could reduce power consumption by driving bi-level video for text, and switching to grayscale drive only when displaying pictures or illustrations.

Figure 1:
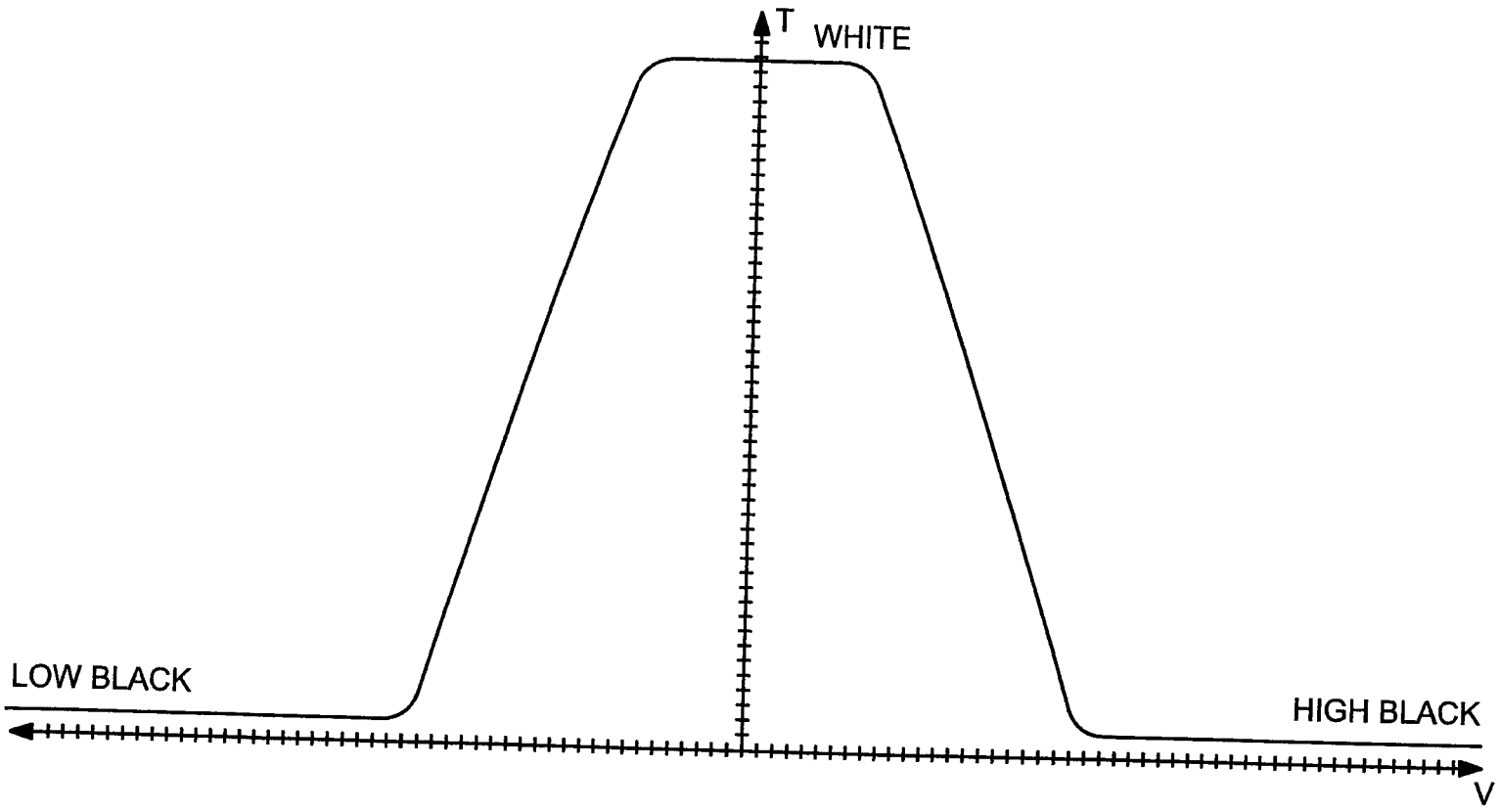
FIG. 1 PRIOR ART
FIG. 1 is a representative transmission versus voltage diagram.
Figure 2A:
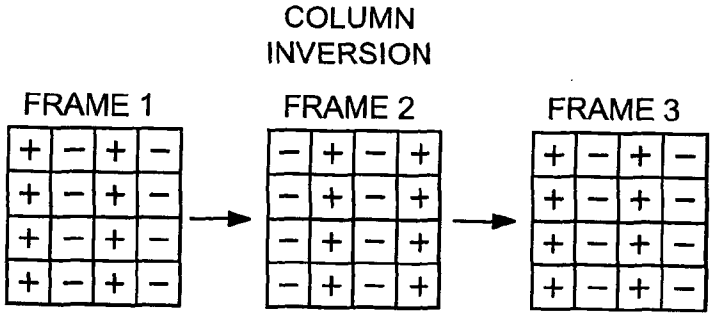
FIG. 2A PRIOR ART
FIGS. 2A-2D are diagrams showing successive frames using column inversion, frame inversion, pixel inversion and row inversion, respectively.
Figure 2B:
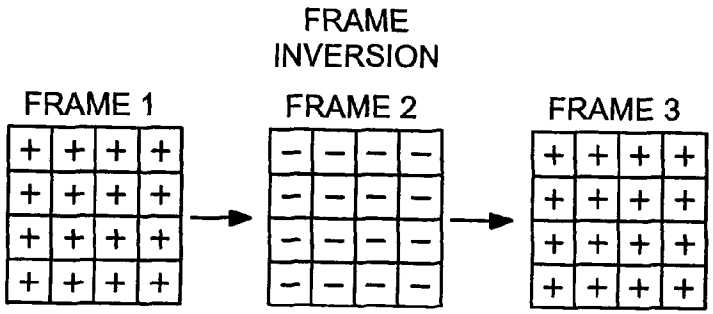
FIG. 2B PRIOR ART
Figure 2C:
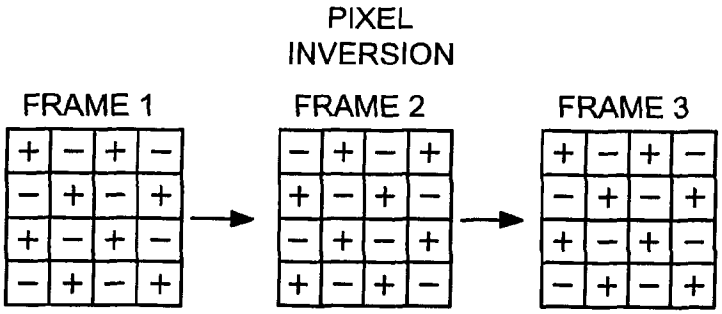
FIG. 2C PRIOR ART
Figure 2D:
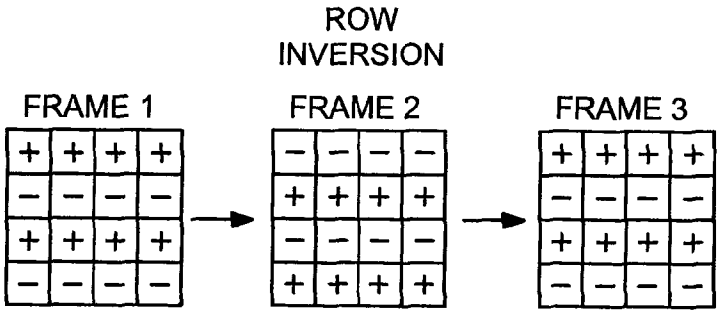
FIG. 2D PRIOR ART
Figure 3:
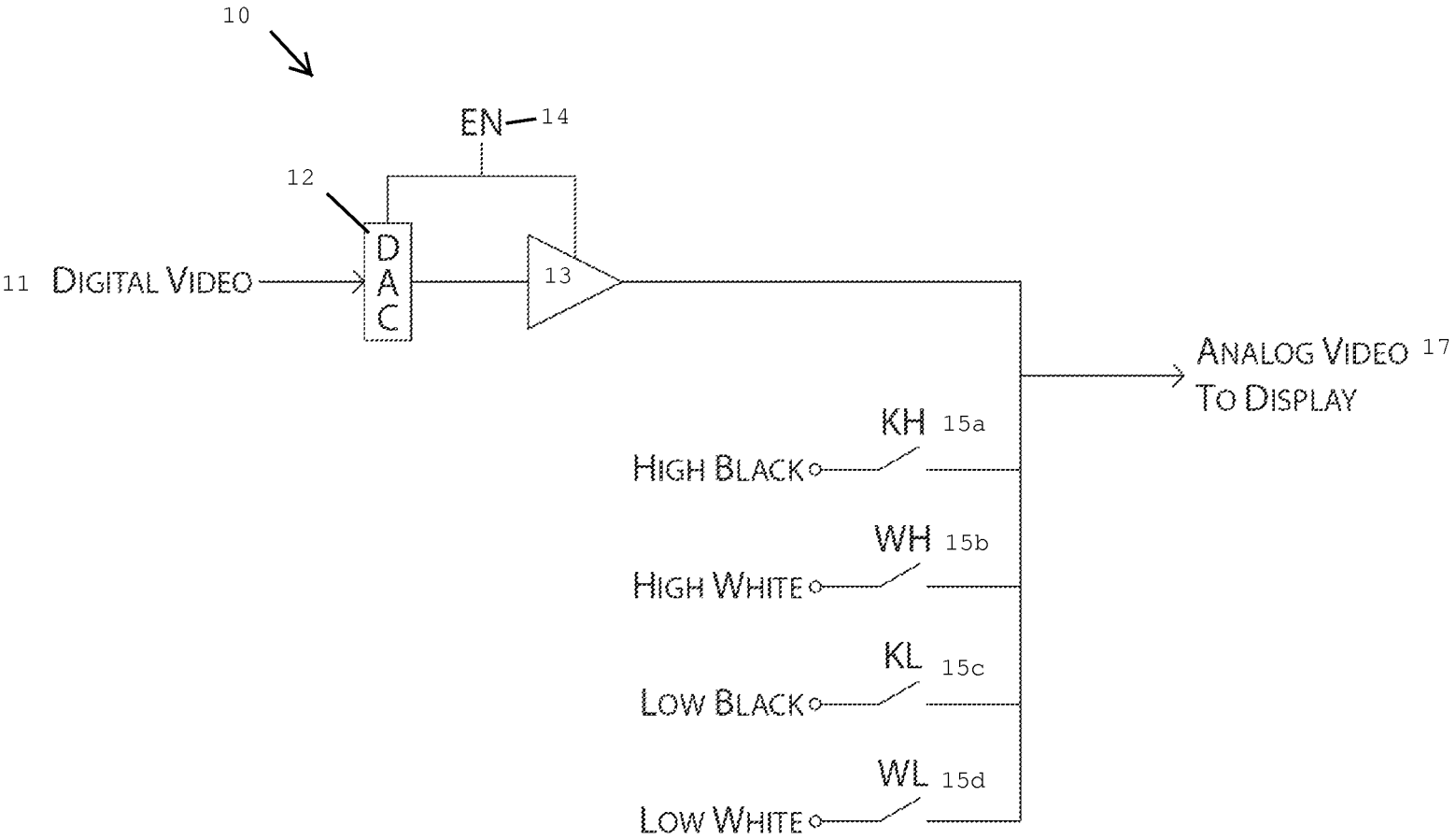
FIG. 3 is a high-level schematic diagram of a circuit capable of selectable grayscale and bi-level mode operation.

FIG. 3 shows a high-level schematic diagram of an example embodiment of a display driver circuit 10 constructed to enable both bi-level and grayscale modes. The display driver circuit 10 includes a DAC 12, a video amplifier 13, and a set of level switches 15*a*-15*d*, receives a digital video signal 11 input and outputs analog video signal 17 to a display, such as a LCD. Enabling signal EN 14 enables the DAC 12 and video amplifier 13 when the driver circuit 10 is operating in the grayscale mode. In the bi-level mode, the DAC 12 and video amplifier 13 are disabled and the set of level switches 15*a*-15*d* is used to select the appropriate voltage level for driving black or white video.

Color displays may also use multiple video inputs for separate red, green, and blue component signals. In the case of color displays, bi-level drive of the red, green, and blue primary colors can produce eight possible colors.

TABLE 1

Combinations of bi-level primary colors

| Red | Green | Blue | Color |
|---|---|---|---|
| 0 + | 0 + | 0 = | Black |
| 1 + | 0 + | 0 = | Red |
| 0 + | 1 + | 0 = | Green |
| 1 + | 1 + | 0 = | Yellow |
| 0 + | 0 + | 1 = | Blue |
| 1 + | 0 + | 1 = | Magenta |
| 0 + | 1 + | 1 = | Cyan |
| 1 + | 1 + | 1 = | White |

Where 0 means the respective color channel is driven to the dark state and 1 means it is driven to the bright state.

For clarity, the following discussion continues to refer to single inputs or input pairs, such as for driving black and white, but the ideas and techniques described may be readily scaled for displays with multiple inputs.

Because most LCDs need to periodically invert the video to prevent damaging the LC cells from prolonged exposure to a DC voltage, two reference voltage levels are used, high and low. To prevent damage in bi-level video mode operation, each reference voltage level (high and low) has a corresponding black and white voltage to drive the display to black or white respectively. In other words, to prevent damaging a LCD operating in bi-level video mode four voltage levels can be used to drive the display: high black (KH), high white (WH), low white (WH) and low black (KH). For the example embodiment shown in FIG. 3, grayscale and bi-level mode operation configurations for amplifier 13 and switches 15*a*-15*d* are summarized below in Table 2. Those of skill in the art will recognize that in cases where the high and low white voltage levels are the same only three switches are needed.

TABLE 2

Switch and amplifier configurations for the circuit of FIG. 3

| Mode | | | EN | KH | WH | WL | KL |
|---|---|---|---|---|---|---|---|
| Gray scale | | | Enabled | Open | Open | Open | Open |
| Bi- | High | Black | Disabled | Closed | Open | Open | Open |
| level | | White | Disabled | Open | Closed | Open | Open |
| | Low | Black | Disabled | Open | Open | Open | Closed |
| | | White | Disabled | Open | Open | Closed | Open |

Figure 4:
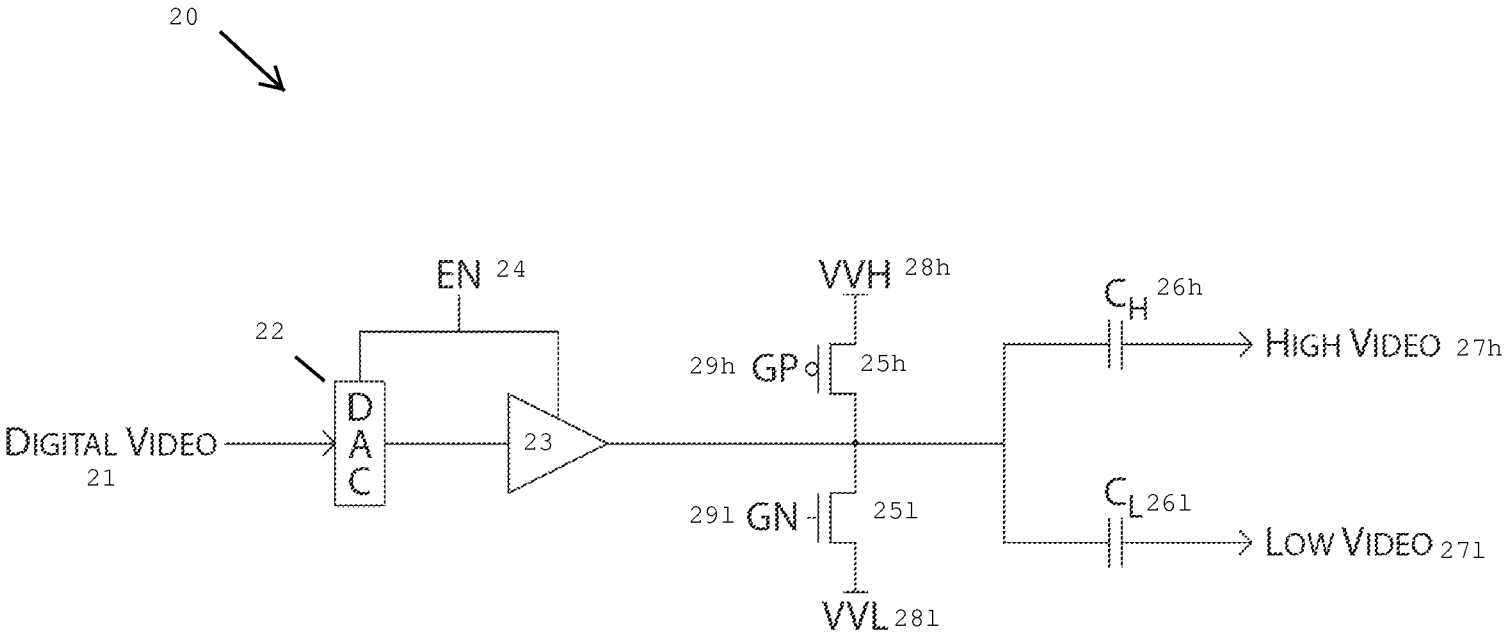
FIG. 4 is a schematic diagram of a circuit with a single amplifier capable of selectable grayscale and bi-level mode operation.
Figure 5:
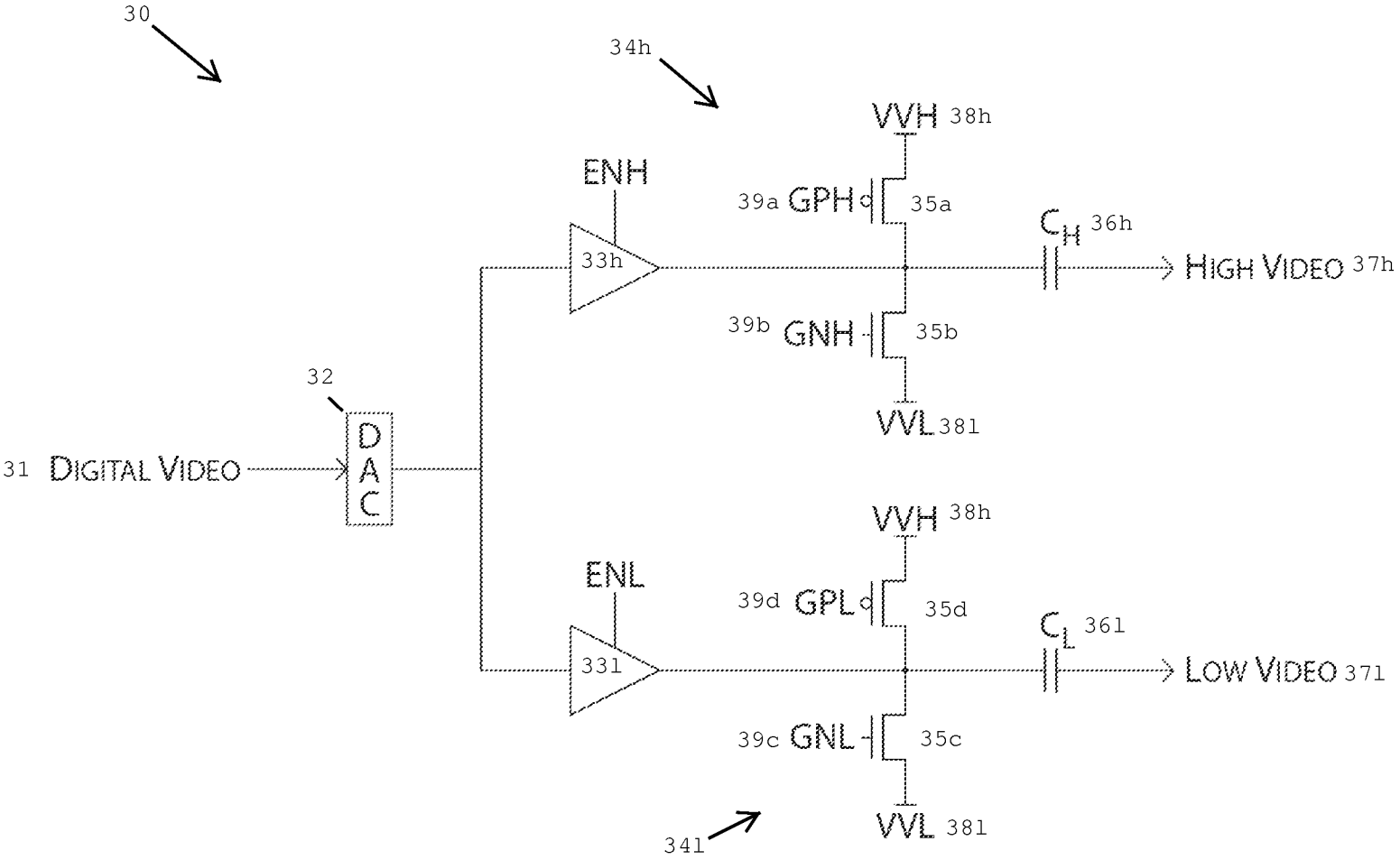
FIG. 5 is a schematic diagram of a circuit with two sub-channels capable of selectable grayscale, bi-level mode and extended DC-restore mode operation.

FIGS. 4 and 5 display example embodiments of display driver circuits that use one and two amplifiers per channel, respectively. The driver circuits of FIGS. 4 and 5 include switches to enable a DC restore mode. The schematic diagrams of FIGS. 4 and 5 contain p-channel and n-channel metal-oxide semiconductor field-effect transistors (MOSFETs) used as switches. These switches provide a functionality similar to the switches 15*a*-15*d* of FIG. 3. The MOSFETs maybe integrated in the same integrated circuit (IC) as the DAC and amplifiers. Those with skill in the art will recognize that any type of switch, such as transistors other than MOSFETs, can be used as switches and may or may not be integrated in an IC chip. The switches enable a DC restore signal to be applied to the display. Many displays, such as those available from Kopin Corporation of Taunton Mass. use capacitively coupled video signals with switches for DC restore integrated in the display.

FIG. 4 is a schematic diagram of an example embodiment display driver circuit 20. The display driver circuit 20 includes a DAC 22, in series with video amplifier 23, the output of the video amplifier 23 coupled to a parallel node with two switches 25*h* and 25*l*, and in parallel with two capacitors, high video capacitor $C_H$ 26*h* and low video capacitor $C_L$ 26*l*. The display driver circuit 20 can be operated in at least two modes, grayscale mode and bi-level mode. For grayscale mode, enable signal EN 24 enables the DAC 22, which converts the digital video signal 21 into a corresponding analog signal. The analog video signal is input into video amplifier 23 (enabled by enable signal EN 24) for amplification. The amplified analog video signal is fed to a circuit node including switches 25*h* and 25*l*, parallel capacitors, $C_H$ 26*h* and $C_L$ 26*l*. Capacitors $C_H$ 26*h* and $C_L$ 26*l* provide high and low video signals 27*h* and 27*l*, respectively, which are used to drive a LCD display.

Switch 25*h* is a p-channel MOSFET device having a gate terminal GP 29*h* and a source terminal coupled to a high video voltage reference VVH 28*h* supply, and a drain terminal coupled to the output of video amplifier 23. Switch 25*l* is a n-channel MOSFET device having a gate terminal GN 29*l*, a drain terminal coupled to the output of video amplifier 23, and a source terminal coupled to a low video voltage reference VVL 28*l* supply.

In bi-level mode, the DAC 22 and video amplifier 23 of display driver circuit 20 are disabled and the set of level switches 25*h* and 25*l* are used to drive two reference voltage states, high and low. The high video reference VVH 28*h* is used for black when driving high video and white when driving low video, and similarly, the low video reference VVL 28*l* is used for white with high video and black for low video. Put another way, when the voltage between the gate GP 29*h* and source is more negative than the threshold voltage of p-channel MOSFET switch 25*h* so that switch 25*h* is closed, the high video reference voltage VVH 28*h* is applied to drive the display to black in bi-level high mode. Similarly, when driver circuit 20 is operating in bi-level low mode and the voltage between the gate GN 29*l* and corresponding source is more positive than the n-channel threshold voltage, MOSFET switch 25*l* is closed, low video reference voltage VVL 28*l* is applied to drive the display to black in bi-level low mode. The configurations for the enablement and settings for the switches are summarized in Table 3 for display driver circuit 20. One benefit of the configuration illustrated in FIG. 4 is that it includes only one amplifier and two switches.

TABLE 3

Switch and amplifier configurations for the system of FIG. 4

| Mode | | | EN | GP | GN |
|---|---|---|---|---|---|
| Gray scale | | | Enabled | H | L |
| Bi-level | High | Black | Disabled | L | L |
| | | White | Disabled | H | H |
| | Low | Black | Disabled | H | H |
| | | White | Disabled | L | L |

FIG. 5 is a schematic diagram of a further example embodiment display driver circuit 30. The display driver circuit 30 includes a DAC 32 feeding parallel high and low video paths (also referred to herein as circuit branches or sub-channels) 34*h* and 34*l*. Each video sub-channel can include a video amplifier, 33*h* and 33*l*, feeding a node with a set of two level switches, level switch set 35*a*, 35*b* and set 35*c*, 35*d*, and a respective high or low capacitor $C_H$ 36*h* and $C_L$ 36*l*.

The example embodiment of display driver circuit 30 can be operated in at least three modes, grayscale, bi-level, and extended DC-restore. While grayscale and bi-level modes are mutually exclusive, extended DC restore is not.

Grayscale mode operates in one of two sub-modes, high video or low video, in which one of the respective sub-channels, high video 34*h* or low video 34*l*, is enabled using a corresponding enable signal, ENH or ENL. The DAC 32 converts a digital video signal 31 into a corresponding analog signal fed to the parallel sub-channel node. For high video grayscale mode, enable signal ENH enables video amplifier 33*h* to amplify an analog video signal received from a DAC 32. The amplified analog video signal is fed to a sub-channel circuit node including a set of level switches 35*a* and 35*b* and high capacitor $C_H$ 36*h*. Capacitor $C_H$ 36*h* provides high video signal 37*h* to drive a LCD.

For low video grayscale mode, enable signal ENL enables video amplifier 33L to amplify an analog video signal received from a DAC 32. The amplified analog video signal is fed to a sub-channel circuit node including a set of level switches 35*c* and 35*d* and high capacitor $C_L$ 36*l*. Capacitor $C_L$ 36*l* provides high video signal 37*l* to drive a LCD.

Switches 35*a* and 35*d* are p-channel MOSFET devices each having a gate terminal GPH 39*a* and GPL 39*d*, a source terminal coupled to a high video voltage reference VVH 38*h* supply, and a drain terminal coupled to the output of a respective video amplifier 33*h* and 33*l*. Switches 35*b* and 35*c* are n-channel MOSFET devices having gate terminals GNH 39*b* and GNL 39*c*, a drain terminal coupled to the output of a respective video amplifier 33*h* and 33*l*, and a source terminal coupled to a low video voltage reference VVL 38*l* supply.

In bi-level mode, the DAC 32 and video amplifiers 33*h* and 33*l* of display driver circuit 30 are disabled and the set of level switches 25*a*-25*d* are used to drive two reference voltage states, high and low. The high video reference VVH 38*h* is used for black when driving high video and white when driving low video, and similarly, the low video reference VVL 38*l* is used for white with high video and black for low video. Put another way, when the voltage between the gate GPH 39*a* and source is more negative than the threshold voltage for MOSFET switch 35*a* so that switch 35*a* is closed, the high video reference voltage VVH 38*h* is applied to drive the display to black in bi-level high mode. Similarly, when driver circuit 30 is operating in bi-level low mode and the voltage between the gate GNL 39*c* and corresponding source is more positive than the threshold voltage, MOSFET switch 35*c* is closed, low video reference voltage VVL 38*l* is applied to drive the display to black.

Alternating between high and low sub-modes for both grayscale and bi-level modes provides an amount of DC-restore to a LCD. Extended DC-restore mode can perform DC-restore for an extended time period, which is useful in some applications. In extended DC-restore mode, when one of the sub-channels is enabled and active, the inactive sub-channel is set to a DC level, for example video reference voltage, VVH 38*h* or VVL 38*l*, using the same switching techniques describes above with reference to the level set of switches 25*a* and 25*b* in FIG. 4. Extended DC-restore mode allows the inactive capacitor almost the entire line period to perform DC-restore, whereas in DC-restore mode DC-restore is performed only during a retrace period, such as a horizontal retrace period. The configurations for the enablement and settings for the switches are summarized in Table 4 for display driver circuit 30.

TABLE 4

Switch and amplifier configurations for the system of FIG. 5

| Mode | | | ENH | ENL | GPH | GNH | GPL | GNL |
|---|---|---|---|---|---|---|---|---|
| Gray scale | | High | Enabled | Disabled | H | L | L* | L |
| | | Low | Disabled | Enabled | H | H* | H | L |
| Bi-level | High | Black | Disabled | Disabled | L | L | L* | L |
| | | White | Disabled | Disabled | H | H | L* | L |
| | Low | Black | Disabled | Disabled | H | H* | H | H |
| | | White | Disabled | Disabled | H | H* | L | L |

*Indicates state for DC restore of inactive channel.

Although it requires more circuitry, a two-amplifier configuration, an example embodiment of which is illustrated in FIG. 5, is useful when driving larger displays with greater load capacitance because each amplifier, for example video amplifiers 33*h* and 33*l*, sees the load of only one of the high or low video signals, such as high and low video signals 37*h* and 37*l*, but not both, as is the case in a single amplifier configuration. Further, the quiescent current of the two amplifiers, such as video amplifiers 33*h* and 33*l*, need not be greater than the quiescent current needed for only one amplifier, because only one amplifier is active at any time and the inactive amplifier may be disabled.

Another benefit of the two-amplifier configuration is that it allows one half of the channel to perform DC restore while the other half is active. Referring to Table 4 and FIG. 5, when GPL 39*d* is set to L while driving high video, setting the left side of $C_L$ 36*l* to VVH 38*h* provides for DC restore. Similarly, GNH 39*b* can be set to H when driving low video to set the left side of $C_H$ to VVL 38*l* to provide DC restore.

Two transistors with gates GNH 39*b* and GPL 39*d* can be used for DC restore in the double amplifier configuration of driver circuit 30, whether or not bi-level mode is supported. With the example embodiment of driver circuit 30, there are two amplifiers per channel, and coupling capacitors, such as $C_H$ 36*h* and $C_L$ 36*l*, are not tied together on their left sides. When one of the amplifiers is active, the other is disabled, and a separate switch can set separately the DC level on the left side of each coupling capacitor. Therefore, implementing bi-level mode therefore can be achieved with a net increase of only two transistors.

While this invention has been particularly shown and described with references to example embodiments thereof, it will be understood by those skilled in the art that various changes in form and details may be made therein without departing from the scope of the invention encompassed by the appended claims.

What is claimed is:

1. A display driver circuit having selectable grayscale and bi-level modes, comprising:

a digital to analog converter (DAC);

a first video amplifier configured to receive an input signal from the DAC and to provide a first output signal to a first node;

a first set of level switches including a first level switch configured to provide a first voltage to the first node;

a second level switch configured to provide a second voltage to the first node;

a second video amplifier configured to receive the input signal from the DAC and to provide a second output signal to a second node;

a second set of level switches including a third level switch configured to provide a third voltage to the second node;

a fourth level switch configured to provide a fourth voltage to the second node;

an enable circuit having a grayscale mode, enabling the DAC and the first and second video amplifiers, and a bi-level mode, enabling a subset of the first, second, third and fourth switches and disabling the DAC and first and second video amplifiers;

a first capacitor configured to AC couple the first node to a first video path; and a second capacitor configured to AC couple the second node to a second video path;

the enable circuit being configured to perform an extended direct current restore mode characterized by:

(i) when the first video amplifier provides the first output signal to the first node, using the second set of level switches to set the second node to a first direct current level; and (ii) when the second video amplifier provides the second output signal to the second node, using the first set of level switches to set the first node to a second direct current level.

2. The display driver circuit of claim 1, wherein a direct current restore (DC restore) to alternate a voltage polarity is provided by the display driver circuit.

3. The display driver circuit of claim 1, wherein the enable circuit operating in the bi-level mode conserves power relative to operating in the grayscale mode.

4. The display driver circuit of claim 1, wherein the first level switch is further comprised of a high voltage level white switch configured to provide a third voltage and a low voltage level white switch configured to provide a fourth voltage.

5. The display driver circuit of claim 1, wherein the DAC, the video amplifier, and the set of level switches are arranged in the same integrated circuit.

6. The display driver circuit of claim 1, wherein the set of level switches is further comprised of:

a p-channel metal-oxide semiconductor field-effect transistor (MOSFET) having a source terminal coupled to a high video reference voltage supply and a drain terminal coupled to an output of the video amplifier; and a n-channel MOSFET having a drain terminal coupled to the output of the video amplifier and a source terminal coupled to a low video reference voltage source.

7. The display driver circuit of claim 1, wherein the set of level switches further comprises at least:
a high voltage level red switch;
a low voltage level red switch;
a high voltage level green switch;
a low voltage level green switch;
a high voltage level blue switch; and
a low voltage level blue switch.

8. The display driver circuit of claim 1, further comprised of:
a high video signal sub-channel, including:
a high video signal sub-amplifier;
a high video signal sub-set of level switches;
a low video signal sub-channel, including:
a low video signal sub-amplifier; and
a low video signal sub-set of level switches.

9. The display driver circuit of claim 8, wherein the enabling circuit further enables a high video extended DC restore mode disabling the high video sub-amplifier and enabling the high video signal sub-set of level switches to provide a high video voltage reference signal.

10. The display driver circuit of claim 8, wherein the enabling circuit further enables a low video extended DC restore mode disabling the low video sub-amplifier and enabling the low video signal sub-set of level switches to provide a low video voltage reference signal.

11. A method of driving a display circuit having selectable grayscale and bi-level modes of operation, the method comprising:
converting a digital video signal to an analog video signal using a digital to analog converter (DAC);
amplifying the analog video signal using a first video amplifier configured to receive the analog video signal from the DAC and to provide a first amplified signal;
amplifying the analog video signal using a second video amplifier configured to receive the analog video signal from the DAC and to provide a second amplified signal
selecting a grayscale mode by enabling the DAC and the first and second video amplifiers using an enable circuit, or a bi-level mode by enabling one of two sets of two or more level switches, each of the level switches configured to provide a separate voltage, and disabling the DAC and video amplifiers;
providing the amplified signal to a first video sub-channel through a first capacitor, and providing the amplified signal to a second video channel through a second capacitor;
performing an extended direct current restore mode characterized by:
(i) when the first video amplifier provides the first output signal to the first node, using the second set of level switches to set the second node to a first direct current level; and
(ii) when the second video amplifier provides the second output signal to the second node, using the first set of level switches to set the first node to a second direct current level.

12. The method of claim 11, wherein the enable circuit further enables a direct current restore (DC restore) to alternate a voltage polarity driving the display circuit.

13. The method of claim 11, wherein selecting bi-level mode operation conserves power relative to selecting grayscale mode operation.

14. The method of claim 11, wherein the selecting uses a set of level switches including:
a high voltage level black switch;
a white voltage level switch; and
a low voltage level black switch.

15. The method of claim 14, wherein the white voltage level switch is further comprised of a high voltage level white switch and a low voltage level white switch.

16. The method of claim 11, wherein the DAC, the video amplifier, and the set of level switches are arranged in the same integrated circuit.

17. The method of claim 11, wherein the set of level switches is further comprised of:
a p-channel metal-oxide semiconductor field-effect transistor (MOSFET) having a source terminal coupled to a high video reference voltage supply and a drain terminal coupled to an output of the video amplifier; and
a n-channel MOSFET having a source terminal coupled to the output of the video amplifier and a drain terminal coupled to a low video reference voltage source.

18. The method of claim 11, wherein the set of level switches further comprises at least:
a high voltage level red switch;
a low voltage level red switch;
a high voltage level green switch;
a low voltage level green switch;
a high voltage level blue switch; and
a low voltage level blue switch.

19. The method of claim 11, further comprised of:
a high video signal sub-channel, including:
a high video signal sub-amplifier;
a high video signal sub-set of level switches;
a low video signal sub-channel, including:
a low video signal sub-amplifier; and
a low video signal sub-set of level switches.

20. The method of claim 19, wherein the enabling circuit further enables a high video extended DC restore mode disabling the high video sub-amplifier and enabling the high video signal sub-set of level switches to provide a high video voltage reference signal.

21. The method of claim 20, wherein the enabling circuit further enables a low video extended DC restore mode disabling the low video sub-amplifier and enabling the low video signal sub-set of level switches to provide a low video voltage reference signal.

* * * * *